US006023916A

United States Patent [19]

Bouthiette

[11] Patent Number: 6,023,916

[45] **Date of Patent: *Feb. 15, 2000**

[54] KIT AND PROCESS FOR THE MANUFACTURE OF A SET OF INDIVIDUAL PILL CONTAINERS

[75] Inventor: Michel Bouthiette, Granby, Canada

[73] Assignee: Dispill Inc., Granby, Canada

[ * ] Notice: This patent is subject to a terminal disclaimer.

[21] Appl. No.: 09/062,509

[22] Filed: Apr. 17, 1998

Related U.S. Application Data

[63] Continuation of application No. 08/862,893, May 23, 1997, Pat. No. 5,788,079

[60] Provisional application No. 60/022,268, Jul. 22, 1996.

[51] Int. Cl.[7] ..... B65B 11/48; B65D 83/04

[52] U.S. Cl. ..... 53/471; 206/534; 206/538

[58] Field of Search ..... 53/476–478, 484, 53/467, 471; 206/538, 539, 534, 570

[56] References Cited

U.S. PATENT DOCUMENTS

| | | | |
|---|---|---|---|
| 3,311,229 | 3/1967 | Troll et al. | 206/539 |
| 3,780,856 | 12/1973 | Braverman | 206/56 AB |
| 3,844,408 | 10/1974 | Reiyea . | |
| 3,924,748 | 12/1975 | Braverman . | |
| 3,933,245 | 1/1976 | Mullen | 206/498 |
| 4,125,190 | 11/1978 | Davie, Jr. et al. . | |
| 4,211,329 | 7/1980 | Braverman . | |
| 4,357,192 | 11/1982 | Moser | 156/252 |
| 4,416,375 | 11/1983 | Braverman et al. . | |
| 4,553,670 | 11/1985 | Collens | 206/534 |
| 4,664,262 | 5/1987 | White | 206/534 |
| 4,733,362 | 3/1988 | Haraguchi | 364/479 |
| 4,844,246 | 7/1989 | Harrison et al. . | |
| 4,860,899 | 8/1989 | McKee | 206/534 |
| 4,998,623 | 3/1991 | Doull . | |
| 5,014,861 | 5/1991 | Wick . | |
| 5,019,125 | 5/1991 | Rebne et al. . | |
| 5,046,618 | 9/1991 | Wood | 206/532 |
| 5,174,451 | 12/1992 | Niven . | |
| 5,259,499 | 11/1993 | Boettger . | |
| 5,325,968 | 7/1994 | Sowden . | |
| 5,358,118 | 10/1994 | Thompson et al. . | |
| 5,379,572 | 1/1995 | Giovannone | 53/478 |

FOREIGN PATENT DOCUMENTS

| | | |
|---|---|---|
| 1310936 | 12/1992 | Canada . |
| 0 077 756 B1 | of 0000 | European Pat. Off. . |

*Primary Examiner*—Jim Foster
*Attorney, Agent, or Firm*—Darby & Darby

[57] ABSTRACT

A kit to sort out pills, tablets or capsules, which comprises a recessed support, a container-defining sheet designed to fit into the support, and a sealing sheet made of self-adhesive paper as having substantially the same dimension as the container-defining sheet, so as to close the same. Positioning elements are provided on the sealing sheet and on the support and/or the container-defining sheet in order to facilitate proper fixation of the sealing sheet on top of the container-defining sheet. A pill-sorting device made of two sliding panels with hollow bottomed recesses can be used to insert the pills into the containers of the container-defining sheet.

13 Claims, 10 Drawing Sheets

KIT AND PROCESS FOR THE MANUFACTURE OF A SET OF INDIVIDUAL PILL CONTAINERS

This is a continuation of application Ser. No. 08/862,893, filed May 23, 1997, U.S. Pat. No. 5,788,079. This prior application is hereby incorporated herein by reference in its entirety. This application also claims domestic priority of provisional application Ser. No. 60/022,268, filed Jul. 22, 1996.

BACKGROUND OF THE INVENTION

A) Field of the Invention

The invention relates to a kit for "sorting" pills and/or tablets. More particularly, it relates to a kit that can be used by a pharmacist, a nurse or any other person entitled to do so, for the purpose of preparing a set of individual containers containing pills and/or tablets to be administered to a patient. Each of these containers contains the pills and/or tablets that the patient has to take together at the same time during the day over a given period of time (preferably one week).

B) Description of the Prior Art

To prepare a set of individual pill containers for use by a patient, it has already been suggested to use a sheet of plastic material in which a plurality of recesses are molded. Each of these recesses defines a small upwardly opened container that can be filled with pills. After filling, all the containers are closed by means of a plastic sealing sheet on which can be printed all the desirable indications like the patient's name, the date and hour of administration, etc. . . . The sealing sheet is applied onto the container-defining sheet and thermo-sealed onto same. As can be understood, the indications are printed and formatted onto the sealing sheet so that each group of information referring to a given container be positioned in regard to the said container. Tearing lines are provided on both the container-defining sheet and the sealing sheet to allow for easy separation of the individual pill containers.

This assembly is efficient. However, it has some drawbacks. More particularly, it is very difficult and time consuming to ensure correct positioning of the preprinted sealing sheet on top of the containers. As can be understood, incorrect positioning of the sealing sheet will make the pill containers difficult to separate. Also, thermo-sealing is not economical, as it calls for thermo-sealing equipment.

SUMMARY OF THE INVENTION

To overcome the above drawbacks, the present invention provides a kit for the manufacture of a set of individual pill containers, which makes it possible to use a conventional self-adhesive sheet of paper hereinafter called "container-sealing sheet" (or "sticker") to cover and seal the containers. As a result, no thermo-sealing equipment is required. The sealing step can be carried out by simply applying the self-adhesive sheet of paper onto the container-defining sheet.

To ensure correct positioning of the self-adhesive sheet of paper over the containers, positioning means are also provided onto at least the top surface of the container defining sheet and the container-sealing sheet.

More particularly, the invention relates to a kit for the manufacture of a set of individual pill containers, which comprises a container-defining sheet made of a plastic material. This sheet has a top surface comprising a given number of evenly spaced apart cavities embossed therein.

Each of these cavities is upwardly opened and thus defines a container. Each container is surrounded by a flange of a given width provided with a central dotted line punched therein. Such dotted lines are provided on all of the flanges thereby making it possible to detach each of the containers from the container-defining sheet and from the adjacent containers.

The kit of the invention also comprises a recessed support having a top surface provided with a number of recesses at least equal to the number of cavities embossed in the container-defining sheet. These recesses are positioned, shaped and sized to receive the containers defined by the cavities embossed in the container-defining sheet.

The kit of the invention further comprises a container-sealing sheet made of paper. This sheet has a top surface and a bottom surface, and is shaped and sized to cover at least all the containers and surrounding flanges of the container-defining sheet. The bottom surface of the container-sealing sheet has bands covered with a self-adhesive material that are positioned, shaped and sized to correspond exactly to and fit over the flanges of the container-defining sheet. These bands are covered until use by a protective peelable paper covering and are provided with central tearing lines. These tearing lines make it possible to tear the container-sealing sheet apart into a number of cover pieces corresponding to the number of said containers.

Positioning means are provided onto at least the top surface of the container-defining sheet and the container-sealing sheet. These means ensure that, in use, after the container-defining sheet is fitted onto the recessed support, the paper covering is peeled off from the bands of the container-sealing sheet, and the container-sealing sheet is positioned on top of the top surface of the container-defining sheet, the bands covered with a self-adhesive material and their tearing lines must be in exact superposition on top of the flanges and the dotted lines of the container-defining sheet.

The invention further provides a device for opening with a knife a set of individual pill containers like the one made with the kit of the invention, which comprises:

a container-defining sheet made of plastic material which has a top surface of a rectangular shape comprising a given number of evenly spaced apart cavities embossed therein. Those cavities are upwardly opened and thus define a container having a bottom. Each of the containers are surrounded by a flange of a given width; and, container-sealing sheet which is fastened over the top surface of the container-defining sheet. The container-sealing sheet is shaped and sized to cover at least all the containers and surrounding flanges of the container-defining sheet.

The device according to the invention for opening with a knife a set of individual pill containers, comprises a flat base member and a "U"-shaped flange which projects downwardly from said flat member. The "U"-shaped flange member comprises a bottom flange portion and two lateral opposite flange portions having a given length. The base portion and flange portions together define a cavity sized to fit onto the set of individual set of pill containers when said set is in an upside down position.

Each of the two lateral opposite flange portions are provided with a continuous horizontal slot which extends over its length at a short distance from the flat base portion, so that, when the set of individual pill containers is inserted upside down in the cavity, the slots extend slightly under the bottom of the containers.

Thus, one can cut the bottoms of the containers of the set of individual pill containers by inserting a knife trough the slots of the two lateral flange and moving said knife from a first position which is distant from the base member to a second position which is close to the base member.

The invention also provides a pill-sorting device that can be used with the kit disclosed hereinabove or with any similar kit comprising:

a) a container-defining sheet made of a plastic material, which has a top surface comprising a given number of evenly spaced apart cavities embossed therein. Each of these cavities is upwardly opened and thus defines a container. Each of the containers is surrounded by a flange of a given width provided with a central dotted line punched therein, said dotted lines are provided in all of said flanges making it possible to detach each of the containers from the container-defining sheet and from the adjacent containers;

b) a recessed support having a top surface provided with a number of recesses at least equal to the number of cavities embossed in the container-defining sheet. These recesses are positioned, shaped and sized to receive the containers defined by said cavities embossed in the container-defining sheet; and c) a container-sealing sheet which is shaped and sized to cover at least all the containers and surrounding flanges of the container-defining sheet.

The pill-sorting device according to the invention comprises:

a first panel and a second panel stackable onto the top surface of the container-defining sheet after said container-defining sheet is fitted onto the recessed support, the first panel has a top surface comprising a set of half-bottomed recesses which are positioned, sized and shaped exactly like the containers of the container-defining sheet. Each of the half-bottomed recesses of the first panel has a bottom wall that extends above one of the containers of the container defining sheet when said first panel is stacked onto the top surface of the container-defining sheet. The bottom wall of the half-bottomed recesses is provided with a flat surface area and with at least one opening sized to allow at least one pill to fall into the container extending under said bottom wall;

the second panel has a top surface comprising a set of hollow bottomed recesses each having a hollow bottom. These hollow bottomed recesses are smaller in size than the half-bottomed recesses of the first panel and are positioned so as to fit into said half-bottomed recesses when the second panel is stacked onto the top surface of the first panel. These hollow bottomed recesses are respectively positioned so as to be slideable in unison within the half-bottomed recesses of the first panel between a first position, where said hollow bottomed recesses extend over the flat surface areas of the half-bottomed recesses, and a second position where said hollow bottomed recesses extend over the openings made in the half-bottomed recesses;

whereby, in use, one may place pills into the half-bottomed recesses of the second panel while the second panel is in the first position, and then slide the first panel so as to cause said pills to fall down into the containers extending under the half-bottomed panels without seeing the other pills that may already have been placed into these containers.

The invention further provides a method for the manufacture of a set of pill containers, using a kit of the invention. The method comprises the steps of:

engaging the cavities of the container-defining sheet into the recesses of the recessed support;

filling each cavity with a given number of pill(s);

peeling off the paper covering of the container sealing sheet;

engaging the positioning means provided on the top of the container-defining sheet together with the one provided on the container sealing sheet; and pressing the bands of the bottom surface of the container-sealing sheet to the top surface of the container-defining sheet so that said bands covered with a self-adhesive material and their tearing lines are in exact superposition on top of the flanges and the dotted lines of the container-defining sheet and become glued to said flanges.

The invention will be better understood upon reading the following non restrictive description of two preferred embodiments of the invention made with reference to the accompanying drawings.

DESCRIPTION OF TWO PREFERRED EMBODIMENTS OF THE INVENTION

The kit according to the invention is intended to be used for the preparation of a set of containers each containing pills and/or tablets to be administered to a patient at given dates and times.

Figure 1:
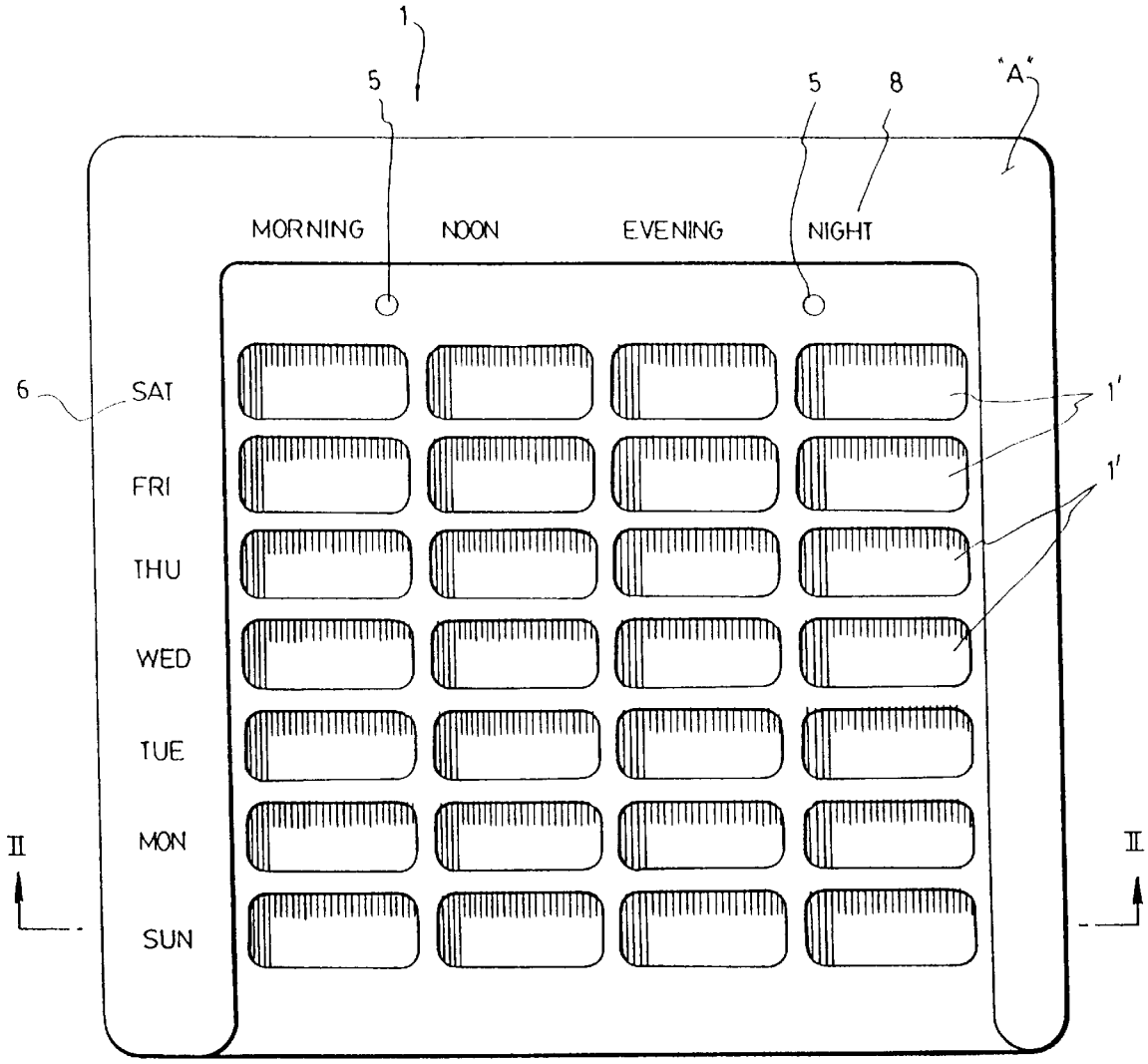
FIG. 1 is a top plan view of the recessed support of the kit according to a first preferred embodiment of the invention.
Figure 2:
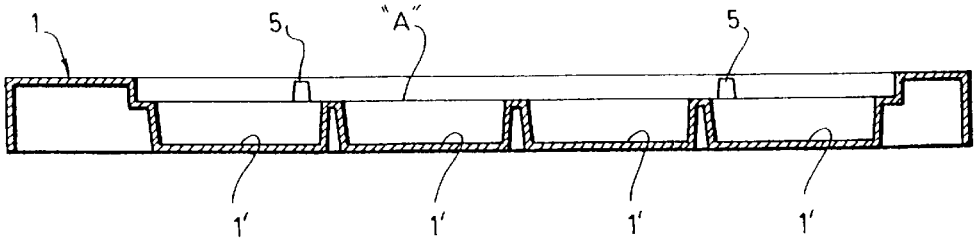
FIG. 2 is a front elevational cross-section view taken along line II—II of the support shown in FIG. 1.
Figure 3:
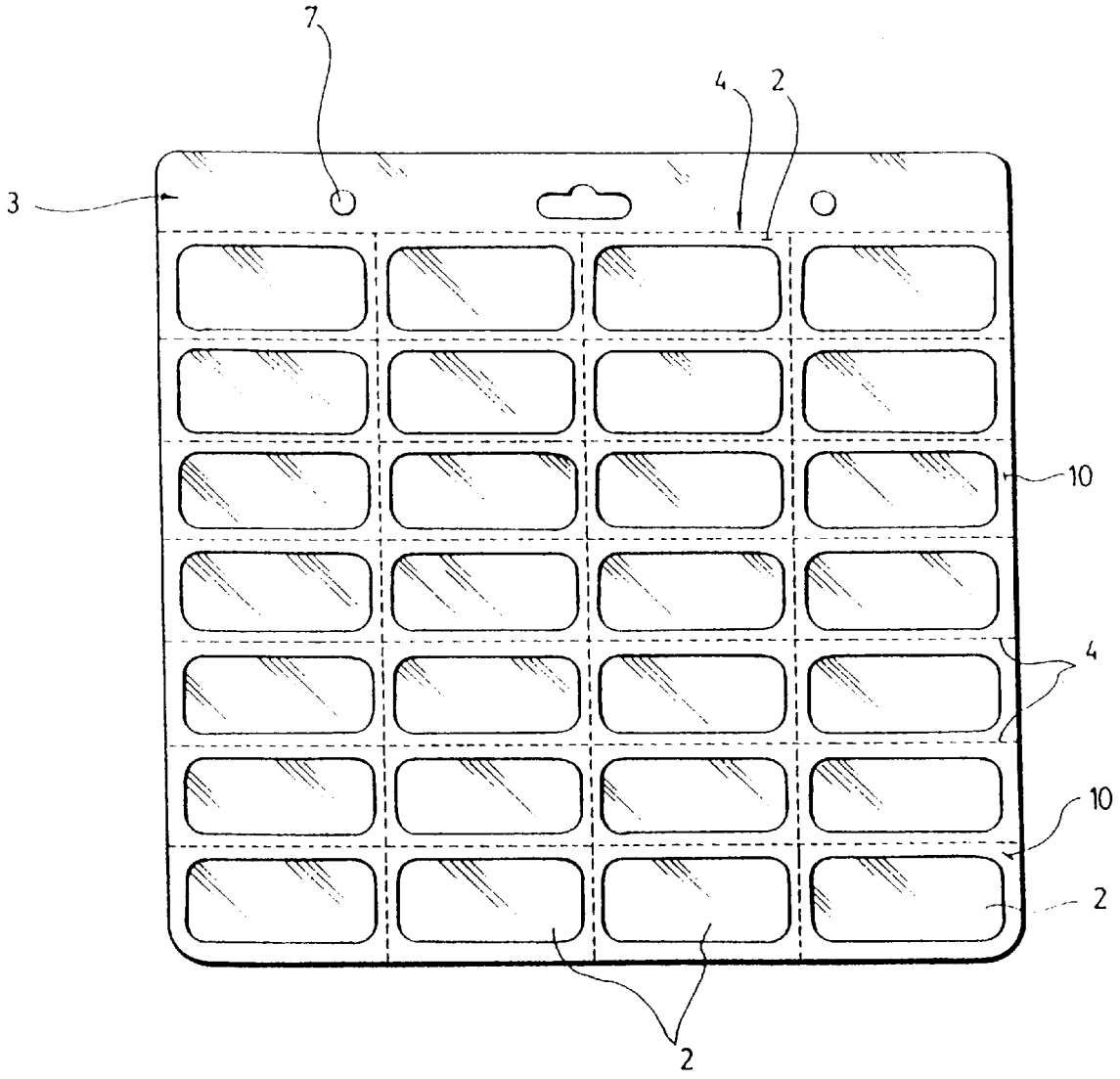
FIG. 3 is a top plan view of a plastic sheet defining a plurality of individual containers, that can be used as a container-defining sheet in the kit according to the invention.
Figure 5:
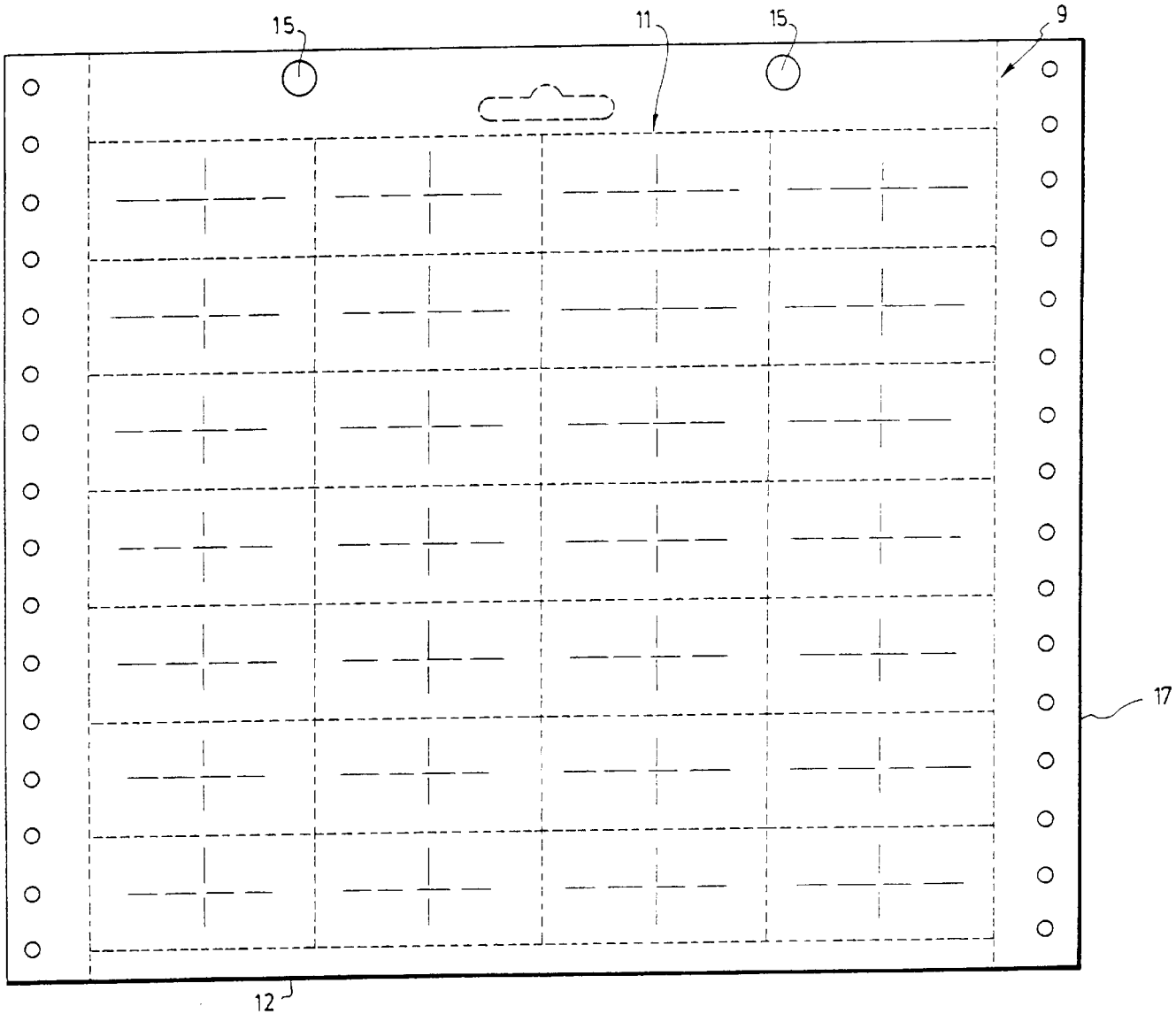
FIG. 5 is a top plan view of a sealing sheet made of self-adhesive paper for use to seal the containers of the container-defining sheet.

This kit comprises a recessed support (1) made of a rigid plastic material. This support is shown alone in FIGS. 1 and 2. The kit also comprises a container-defining sheet (3) also made of moulded plastic material. This sheet (3) is shown alone in FIG. 3. The kit further comprises a container-sealing sheet (9) made of paper. This sheet (9) is shown alone in FIG. 5.

The sheet (3) defining the pill containers is preferably made of transparent plastic. It is moulded so as to define a plurality of evenly spaced apart cavities on its top surface, each of these cavities being upwardly opened and thus defining individual container (2). Each of these containers (2) is surrounded with a flange (10) of a given width which is provided with a central tearing or dotted line punched therein. Each container (2) can be detached from the container-defining sheet (3) and from the others containers (2) thanks to this set of dotted lines (4).

The support (1) is designed to receive, hold and support the container-defining sheet (3). For this purpose, it comprises on its top surface a slightly recessed area "A" having the same size as the sheet (3) in order to receive same. In the recessed area "A", the support (1) also comprises a number of recesses (1') at least equal to the number of cavities embossed on the container-defining sheet (3) and that are positioned, shaped and sized to receive the containers (2) moulded in the container-defining sheet (3).

The container-sealing sheet (9) is shaped and sized to cover at least all the containers (2) and surrounding flanges (10) of the container-defining sheet (3). The bottom surface of this container-sealing sheet (9) has bands (18) covered with a self-adhesive material that are positioned, shaped and sized to exactly correspond to and fit over the flanges (10) of the container-defining sheet (3). These bands (18) are covered until use by a protective peelable paper covering (19). The container-sealing sheet (9) is provided with central tearing lines (11) to match dotted lines (4) of the container defining sheet (3). These tearing lines (11) make it possible to tear said container-sealing sheet (9) into a number of cover pieces or lids 12 corresponding to the number of the containers (2).

Positioning means are provided onto at least the top surface of the container-defining sheet (3) and on the container-sealing sheet (9) to ensure that, when the latter is positioned on top of the top surface of the container-defining sheet (3), the bands (18) and their tearing lines (11) be in exact superposition on top of the flanges (10) and the dotted lines (4) of the container-defining sheet (3). In the illustrated embodiments, which are preferred ones, these positioning means comprise two protuberances (5) provided on the support (1) and which project upwardly from the top surface of the recessed area "A". The positioning means also comprises the holes (7), provided with the container-defining sheet (3) container-sealing sheet (9), two holes (15) sized and positioned to engage the two protuberances (5) of the support (1).

Preferably, the containers (2) of the sheet (3) and the recesses (1') of the support (1) receiving the sheet (3) are respectively of a number of twenty-eight. These containers (2) and recesses (1') may be shaped so as to define four columns corresponding to the four periods of the day when pills are usually given (i.e. morning, noon, evening and night). When a set of pills is to be administered over a week, the sheet (3) also comprises seven rows, each corresponding to one day per week (see FIGS. 1 to 6). However, such numbers of recesses (1') and containers (2) and/or columns and rows can be changed if need be.

Figure 4:
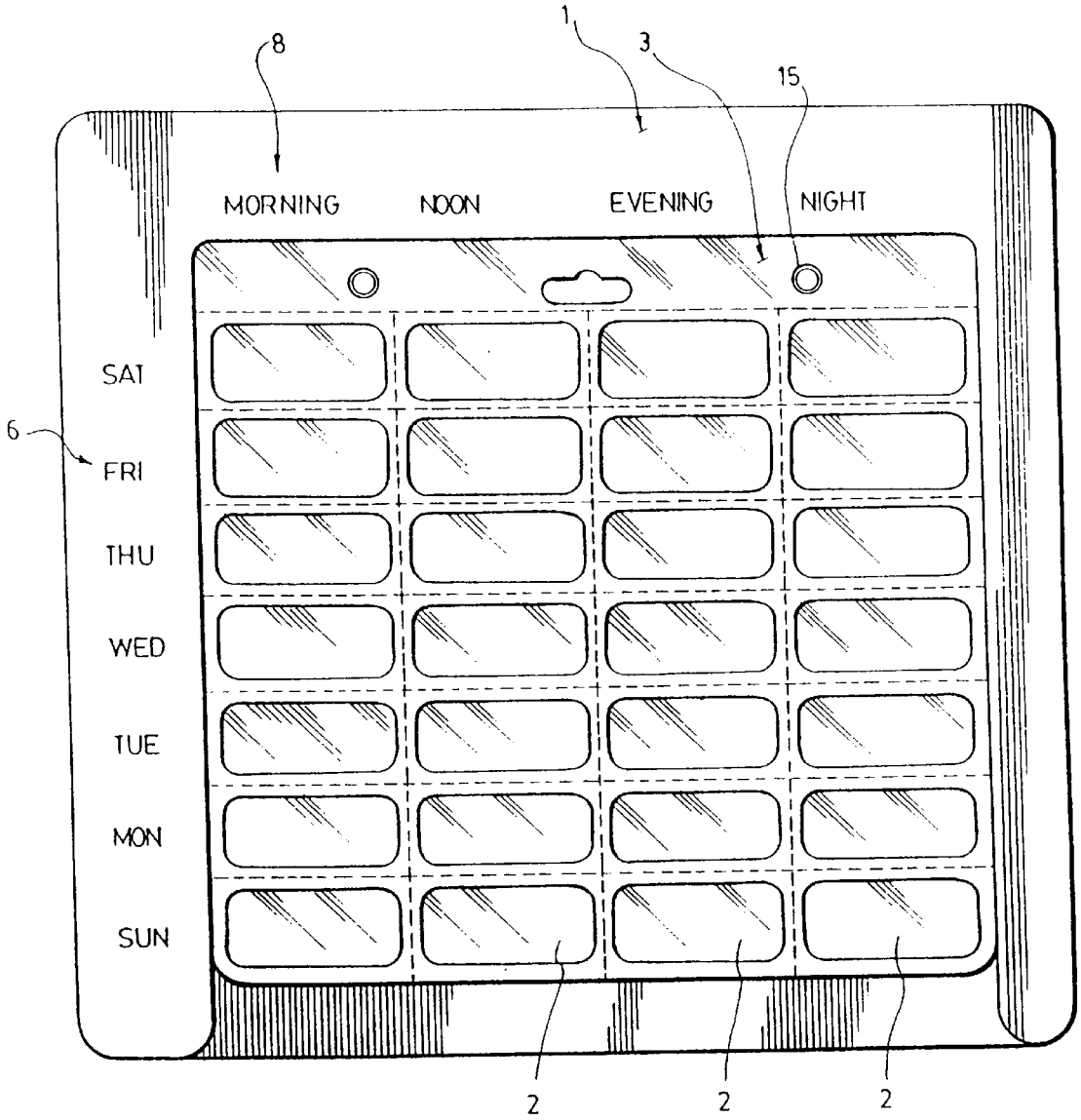
FIG. 4 is a top plan view of the support shown in FIG. 1, on which the container-defining sheet shown in FIG. 3 is mounted.

To manufacture a set of pill containers, an empty container-defining sheet (3) is set onto the recessed support (1), as is shown in FIG. 4. Then, each container (2) of the sheet (3) is filled with the pills and/or tablets that the patient has to take at the same time during the day. The days (6) and times (8) can be printed on the support to help the pharmacist or nurse in sorting the pills and tablets and completing the filling operation.

Figure 6:
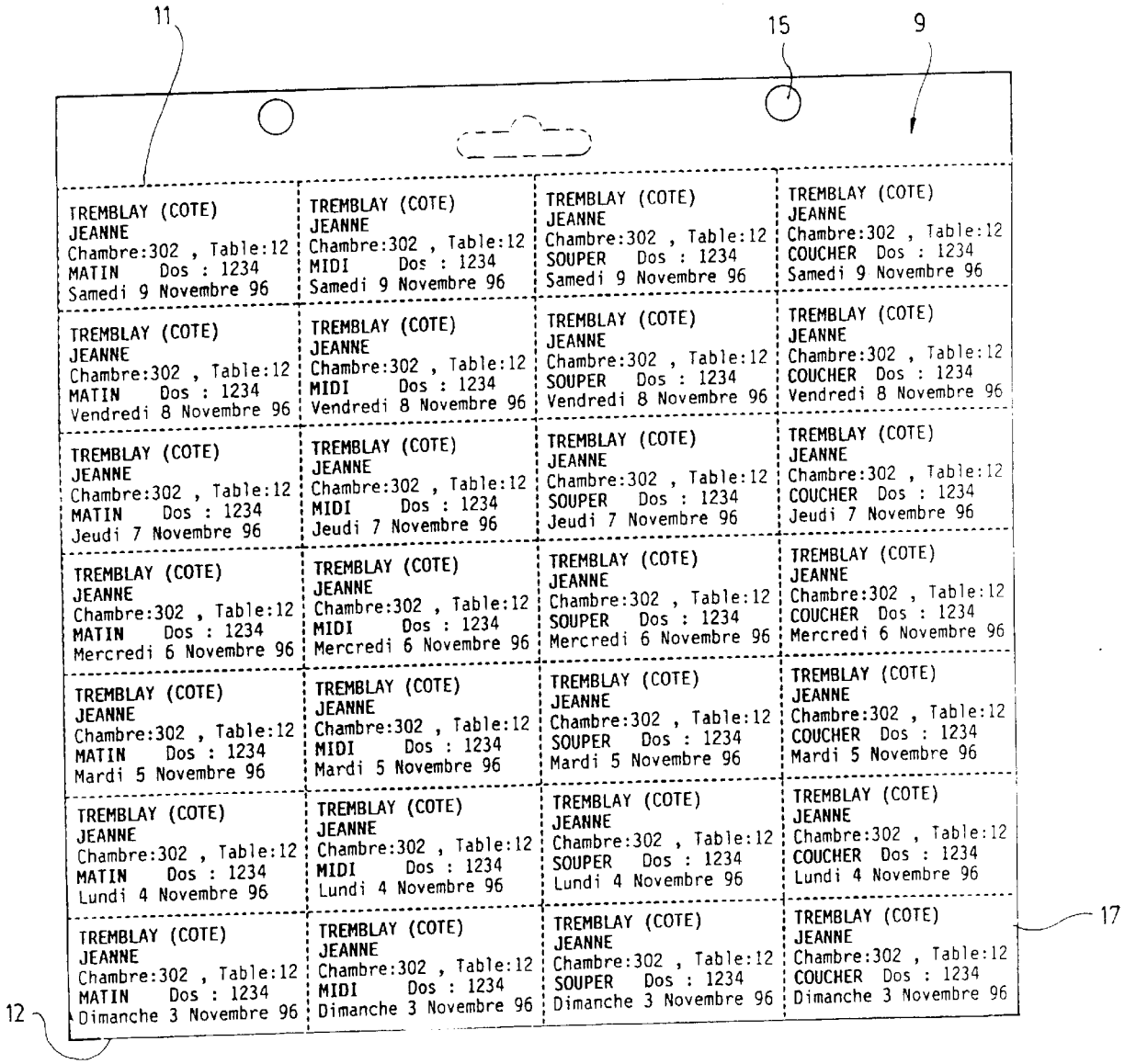
FIG. 6 is a top plan view similar to the one of FIG. 5, showing the same sealing sheet after it has been printed.

Then, the container-sealing sheet (9) (or sticker) which is preferably made of self-adhesive paper, is written or printed to clearly identify each container (2). This operation can be easily performed onto a blank self-adhesive sheet (9), like the one shown in FIG. 5, by using a computer program and a printer. The result is shown in FIG. 6. As mentioned before, tearing lines (11) are provided on the sealing sheet (9) to match the dotted line (4) of the container-defining sheet (3) and thus allow for an easy separation of each sealed container (2). These tearing lines (11) thus define a plurality of individual lid (12).

The following information relating to the patient's prescription, may appear on each individual paper lid (12) defined by the sheet (9) after it has been torn out: name of the patient, day and time of administration; identification of the room or table of the patient; etc. . .

The self-adhesive sheet (9) should be glued only to the frame (10) of the container (2), so as to prevent the pills or tablets from being "stuck" on the lids (12). For this purpose, the back (or bottom) of the sheet (9) is provided with gluing lines or bands (18) sized to fit only onto the flanges (10). These gluing bands (18) are covered and protected by a peelable skin (19) that can be manually peeled off before use.

Because the dotted and tearing lines (11) and (4) have to be precisely one above the other, it is very important that the container sealing sheet (9) be precisely positioned above the container defining sheet (3). To do so, the two holes (15) of the container-sealing sheet (9) engage the two protuberances (5) of the support (1).

It has been found more convenient to provide the support (1) with protuberances, and the container-defining sheet (3) and the container-sealing sheet (9) with corresponding holes. However, some variations can be made without departing from the spirit of the invention. For example, the protuberance(s) to be engaged by the corresponding hole(s) provided on the container-sealing sheet (9), may be moulded directly on the top surface of the container-defining sheet (3) instead of being provided on the support (1).

After the holes (15) of the container-sealing sheet (9) are engaged to the protuberances (5) of the support (1), the paper covering is peeled off the bands (18) of the container-sealing sheet (9) and applied on the top surface of the container-defining sheet (3).

Figure 8:
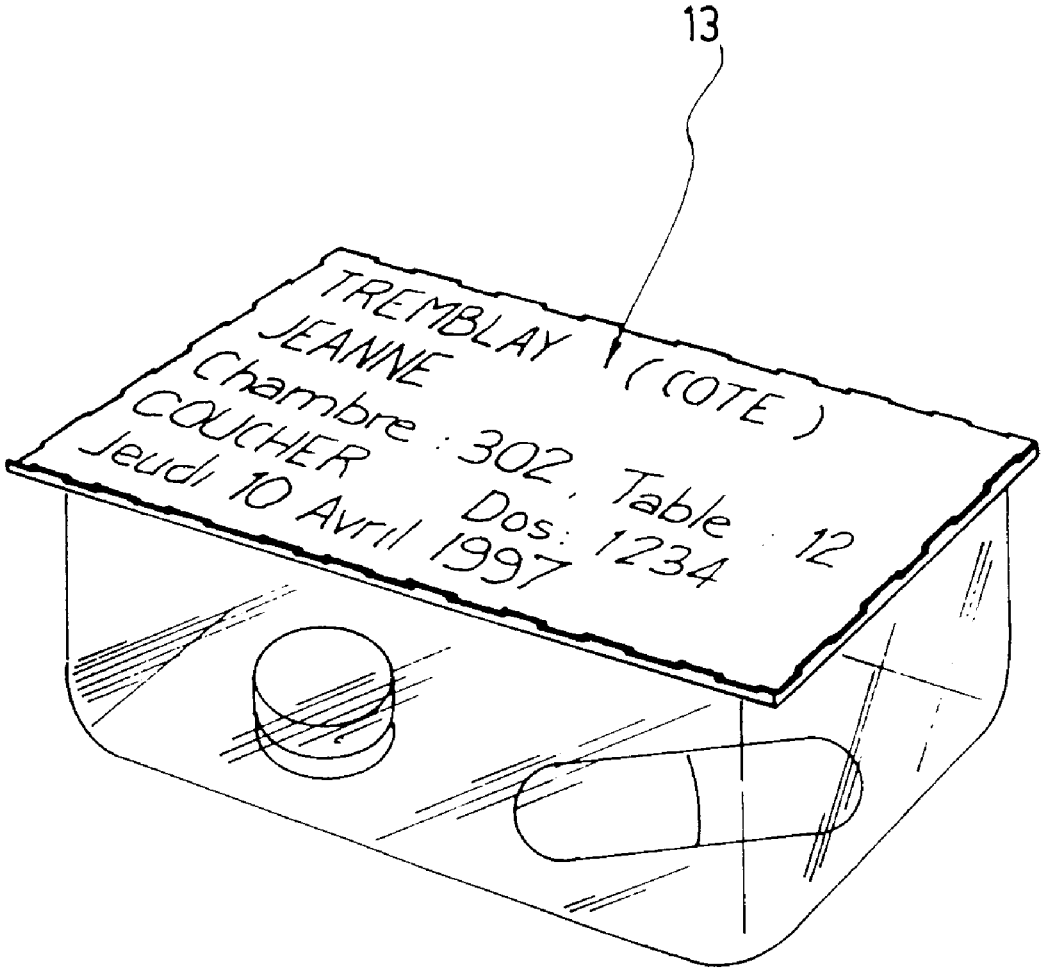
FIG. 8 is a perspective view of an individual sealed container prepared with the kit according to the invention.

Once the container-sealing sheet (9) is glued on top of the container-defining sheet (3), the requested set of individual sealed pill containers (13) is obtained. An individual container (13) thus obtained is shown in FIG. 8.

Figure 7:
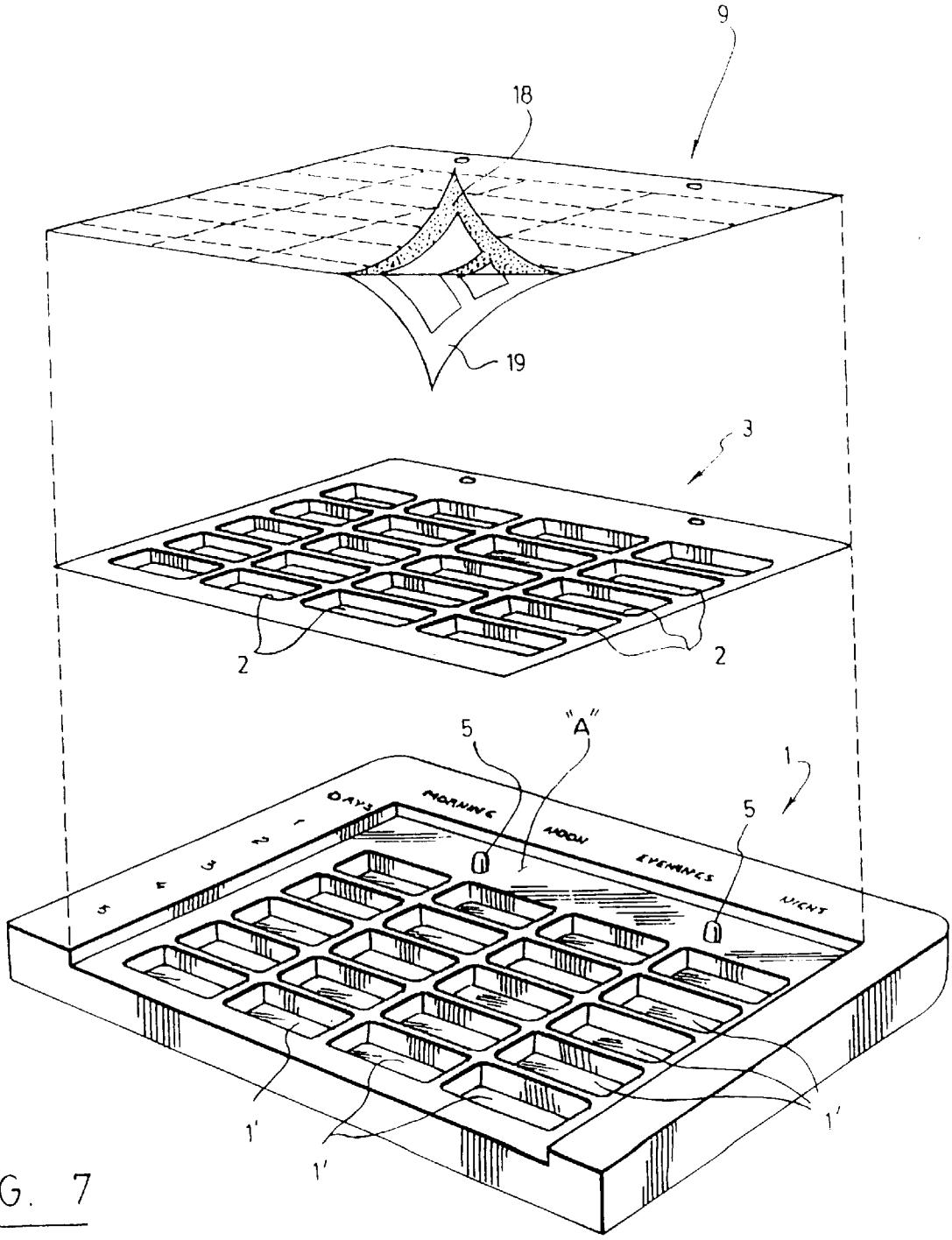
FIG. 7 is an exploded perspective view of the whole kit according to the first embodiment of the invention, showing the recessed support, the container-defining sheet and the sealing sheet.

As shown in FIG. 4, dotted lines (17) may be provided on each paper lid (12) to facilitate perforation of same and thus facilitate easy access to the pills. A sample of a pill container that can be so obtained is shown in FIG. 7.

According to a second particularly preferred embodiment of the invention shown in FIGS. 9 to 11, the kit may further comprise, in addition to the elements which have been described hereinabove, a pill-sorting device (21) comprising a first panel (23) and a second panel (27). It should be noted that the recessed support (1") shown in the second embodiment of the invention slightly differs from the support (1) of the first embodiment as the support (1") in that it does not have a recessed area "A". Apart from that, all the elements of the kit which have already been described in the first embodiment of the invention are similar to the ones of the second embodiment and identical numeral references have been used to identify the same.

Figure 9:
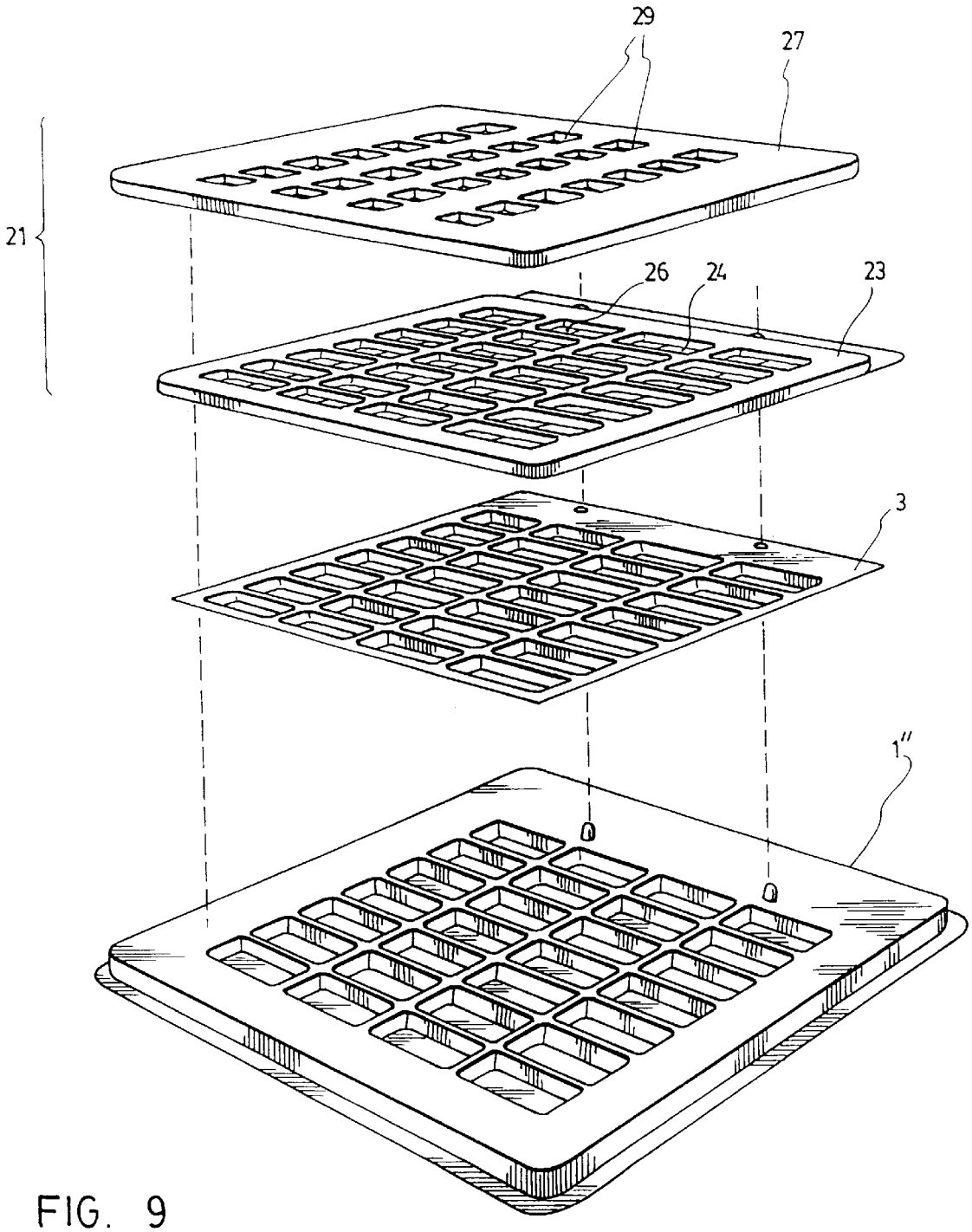
FIG. 9 is an exploded perspective view of a recessed support, a container-defining sheet and a first and a second stackable panel of a pill-sorting device of a kit according to a second preferred embodiment of the invention.
Figure 10:
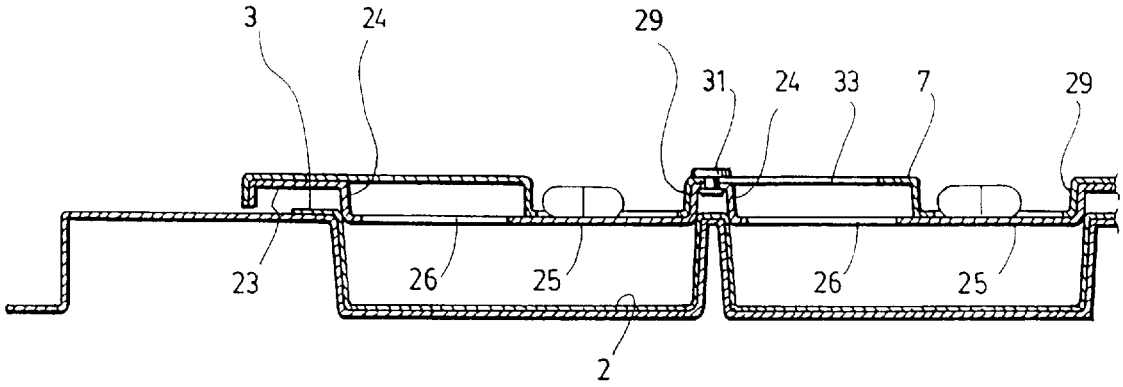
FIG. 10 is a front elevational cross-section view taken along line X—X of FIG. 9, showing the elements stacked one upon the other.
Figure 11:
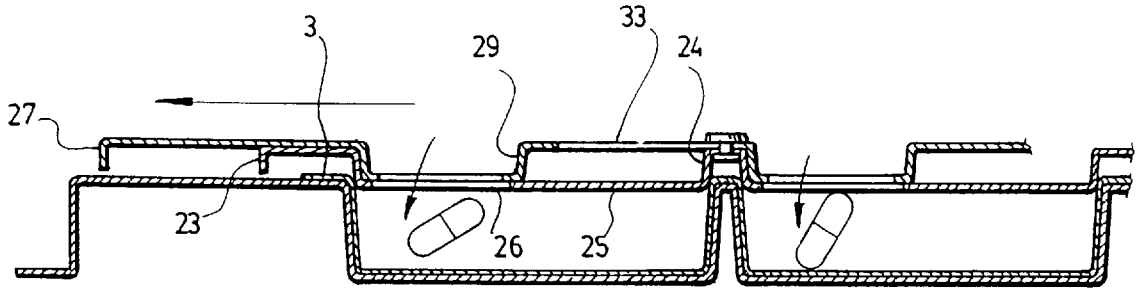
FIG. 11 is a front elevational cross-section view similar to the one of FIG. 10, wherein the second panel slides to the left of the first panel.

As shown in FIGS. 9 to 11, the two panels (23) and (27) are stackable onto the top surface of the container-defining sheet (3) after the latter is fitted onto the recessed support (1"). Advantageously, they should be made of an opaque moulded plastic.

The first panel (23) has a top surface comprising a set of half-bottomed recesses (24) which are positioned, sized and shaped exactly like the containers (2) of the container-defining sheet. Each of the half-bottomed recesses (24) has a bottom wall (25) that extends above one of the containers (2) of the container-defining sheet (3) when the panel (23) is stacked onto the top surface of said container-defining sheet (3). The bottom wall (25) is provided with a flat surface area and with at least one opening (26) which is sized to allow at least one pill to fall into the container (2) extending under the bottom wall (25).

Preferably, the openings (26) in the bottom wall (25) of the half-bottomed recesses (24) of the first panel (23) occupy half of the surface area of the bottom wall (25) and are located on one side of the corresponding half-bottomed recesses (24).

Preferably also, the first panel (23) can be provided with two holes (35), each of them being sized and positioned to correspond to and be engaged by one of the protuberances (5) of the recessed support (1").

The second panel (27) has a top surface which comprises a set of hollow bottomed recesses (29) each having a hollow bottom. The hollow bottomed recesses (29) are smaller in size than the half-bottomed recesses (24) of the first panel (23) and are positioned so as to fit into said half-bottomed recesses (24) when the second panel (27) is stacked onto the top surface of the first panel (23). These hollow bottomed recesses (29) are respectively positioned so as to be slide in unison within the half-bottomed recesses (24) of the first panel (23) between two positions. The first position shown in FIG. 10, is defined when the hollow bottomed recesses (29) extend over the flat surface areas of the half-bottomed recesses (24). The second position shown in FIG. 11, is defined when the hollow bottomed recesses (29) extend over the openings (26) made in the half-bottomed recesses (24).

The first and the second panels (23) and (27) may be secured together with at least one rivet (31), and preferably two. Such rivets (31) are not shown in FIG. 9 in order to allow the best view of the first panel (23). However, such a rivet (31) is represented on the cross-sectioned view of FIGS. 10 and 11. As shown in these figures, the rivet (31) may have a central pin, a top head and a bottom head. The second panel (27) is provided with a longitudinal slot (33) and the rivet (31) passes trough this longitudinal slot (33) and allows the second panel (27) to horizontally slide with respect to the first panel from the first position to the second position. Therefore, the slot (33) has a length relatively equivalent to the length of the half-bottomed recesses.

In use, and as best shown in FIG. 9, the two panels (23) and (27) are stacked onto the container-defining sheet (3), while the latter is positioned onto the support (1') and its holes (35) engaged onto the protuberances (5). Then, one may place one or more pills into each of the hollow bottomed recesses (29) of the second panel (27) while this panel (27) is in the first position (see FIG. 10). Once the pill(s) are on the flat surface of each of the half-bottomed recesses (24) corresponding to an individual container (2) to be filled, the user then slides the second panel (27) so as to cause the pills to fall down into the containers (2) extending under the half-bottomed recesses (24) (see FIG. 11). This method allows the user to sort out individual groups of a given kind of pill without seeing the other pills that may already have been placed into the containers (2).

Once the filling is completed, the panels (23) and (27) are removed from the container-defining sheet (3) and the sealing sheet (9) is positioned and glued as described hereinabove.

It often happens that a patient has to take more than one kind of pill and/or tablet at the same time of the day. When this is the case, the risk of error increases since, due to the mixing of different kinds of pills, it is difficult to control whether the given number of any kind of pill has been effectively put into each requisite container (2). The kit and method of filling according to the second preferred embodiment of the invention allows for an easier control of the contents of each container (2). Indeed, each kind of pill is first positioned on the flat surface of the bottom wall (25) and thus isolated in individual groups from the other pills already present therein. This preliminary step allows the user to have a better and easier visual control of the presence in each container (2) of the requested pills, since all kinds of pills are not immediately mixed together.

It should be noted that the pill sorting device disclosed hereinabove may not only be used with the set of pill containers according to the invention. As a matter of fact, it could also be used with any other kind of previously known set of pill containers, like the thermo-sealed ones.

The resulting set of pill containers is very useful for use in community organizations like hospitals, retirement homes and the like, where numerous patients must be given different medications at the same time. The kit according to the invention permits to reduce the time of preparation of a prescription for each patient. It also reduces the risk of error.

In accordance with a third preferred embodiment of the invention, the kit disclosed hereinabove, may further comprise a device for opening the set of pill containers after it has been manufactured. As a matter of fact, it often happens that the treatment ordered for a patient must be modified and, consequently, new pills and/or drug tablets must be added to the set of pill containers. When the set of pill containers is already made, a completely new set then has to be made from the beginning and to proceed to another filling of each container, pill after pill. This is time consuming.

The present invention provides a device (40) which allows to quickly open the bottom wall of all the containers (2) and then to transfer their contents into another container-defining sheet (3) in a simple and rapid two-step process.

Figure 12:
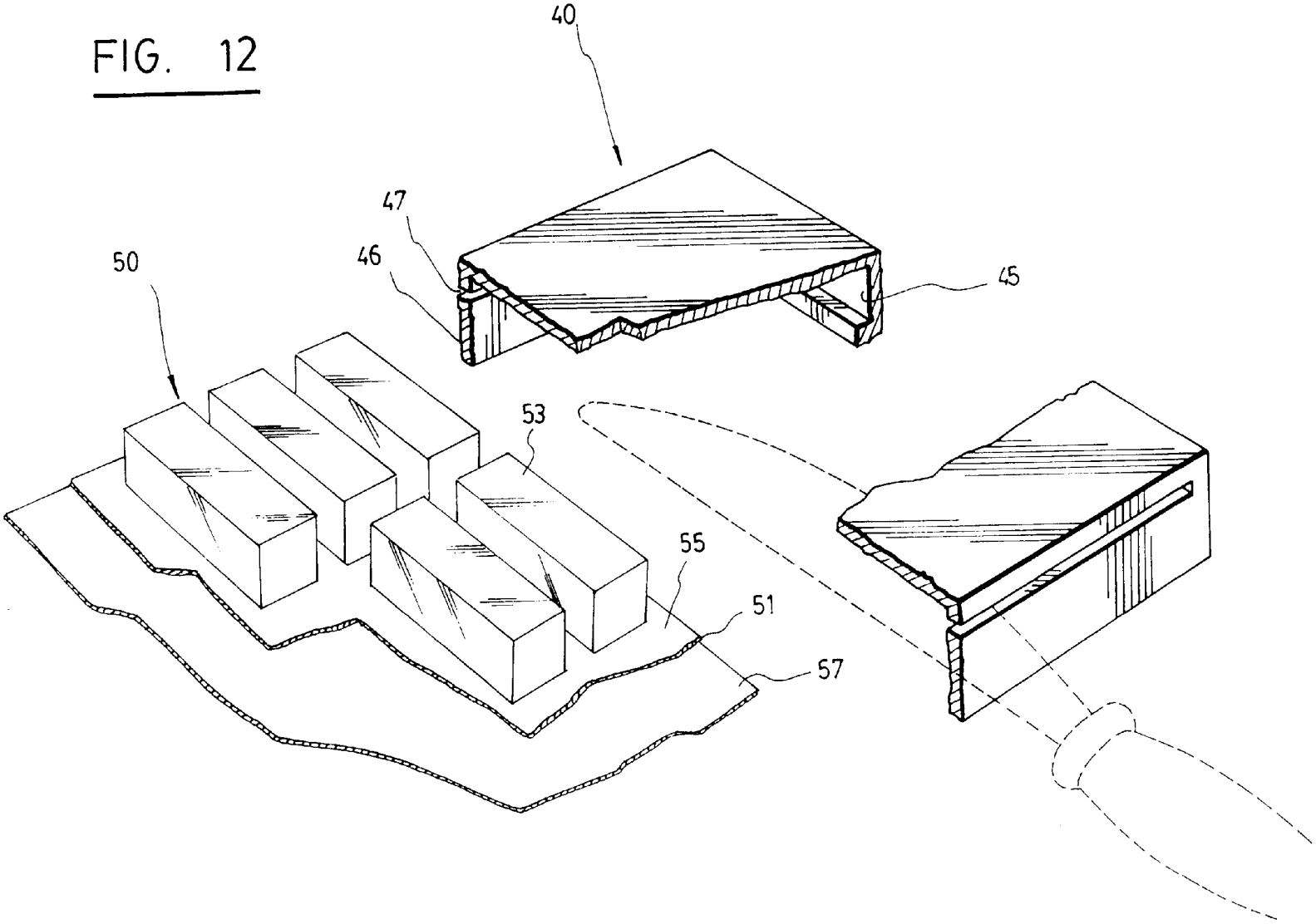
FIG. 12 is a perspective view in partial cross-section of an opening device that can be part of the kit according to the invention, said figure also containing a perspective view in partial cross-section of the container-defining sheet to be opened, in an upside down position.

As shown in FIG. 12, the device (40) is provided, this device (40) is for use in opening with a knife a set of individual pill containers (50). This set of individual pill containers (50) is shown in FIG. 12 in an upside down position and comprises:

a container-defining sheet (51) made of plastic material, which has a top surface of a rectangular shape comprising a given number of evenly spaced apart cavities embossed therein. Each of said cavities are upwardly opened and thus define a container (53) having a bottom, and each of said containers (53) are surrounded by a flange (55) of a given width.

a container-sealing sheet (57) is fastened over the top surface of said container-defining sheet (51). The container-sealing sheet (57) is shaped and sized to cover at least all the containers (53) and surrounding flanges (55) of the container-defining sheet (51).

The device (40) comprises a flat base member (41) and a "U"-shaped flange (43) which projects downwardly from the flat member (41). The "U"-shaped flange member (43) comprising a bottom flange portion (45) and two lateral opposite flanges portions (46) having a given length. In order to render the comprehension easier, FIG. 12 represents a cross-sectioned view of the device (40). Consequently only one of the two lateral opposite flange portions (46) is shown. The other lateral opposite flange portions is symmetrical to the represented one over a longitudinal axis.

The base member (41) and flange members (46) together defining a cavity sized to fit onto the set of individual set of pill containers (50) when the latter is in an upside down position.

Each of the two lateral opposite flange portions (46) are provided with a continuous horizontal slot (47) which extends over its length at a short distance from the flat base member (41). Thus, when the set of individual pill containers (50) is inserted upside down in the cavity, the slots extend slightly under the bottoms of the containers (53).

Thereby, in use, one may position the set of individual pill containers (50) in an upside down position into the cavity of the device (40) and cut the bottoms of the containers (53) of the set of individual pill containers (50) by inserting a knife trough the slots (47) of the two lateral flange portions (46) and moving said knife from a first position which is distant from the base member (41) to a second position which is close to the base member (41).

Once the bottoms of the containers (53) are cut, the device (40) and the cut portions of the bottoms are removed. Then, one just has to position onto the cut container-defining sheet (51) another container defining sheet similar to the cut one. The containers of the other container-defining sheet are positioned so as to engage a portion of the cut containers (53). Then, pressing the two sheets together in that position, the user turns them upside down, thereby provoking the pills contained in each cut containers (53) to fall into a new one.

This process obviously avoids the time consuming step of re-filing the containers defining sheet pill by pill. All that remains to do is to fill each containers with the newly prescribed pills and to proceed with the sealing step. It should be noted that this device and process according to the invention may not only be used with the set of pill containers according to the invention. As a matter of fact, it could also be used with any other kind of previously known set of pill containers, like the thermo-sealed ones.

Although preferred embodiments of the invention have been described in detail herein and illustrated in the accompanying drawings, it is to be understood that the invention is not limited to these precise embodiments and that various changes and modifications may be effected therein without departing from the scope or spirit of the invention.

For example, even though the positioning means according to the invention, preferably comprises two protuberances, it is obvious that more or less of these protuberances may be provided on the support (1') and/or the container-defining sheet (3).

I claim:

1. A kit for the manufacture of a set of individual pill containers, said kit comprising:

a container-defining sheet made of a plastic material, said container-defining sheet having a top surface comprising a given number of evenly spaced apart cavities embossed therein, each of said cavities being upwardly opened and thus defining a container, each of said containers being surrounded by a flange of a given width provided with a central dotted line punched therein, said dotted lines provided in all of said flanges making it possible to detach each of the containers from the container-defining sheet and from the adjacent containers;

a recessed support having a top surface provided with a number of recesses at least equal to the number of cavities embossed in the container-defining sheet, said recesses being positioned, shaped and sized to receive the containers defined by said cavities embossed in the container-defining sheet;

a container-sealing sheet shaped and sized to cover at least all the containers and surrounding flanges of the container-defining sheet, said container-sealing sheet being provided with tearing lines making it possible to tear said container-sealing sheet into a number of cover pieces corresponding to the number of said containers; and positioning means provided onto at least the top surface of the container-defining sheet and on the container-sealing sheet to ensure that, in use, after the container-defining sheet is fitted onto the recessed support, the container-sealing sheet is properly positioned on top of the top surface of the container-defining sheet with the tearing lines in exact superposition on top of the dotted lines of the container-defining sheet;

wherein the recesses of the recessed supports and the cavities of the container-defining sheet are positioned to form regularly spaced apart rows and columns; and wherein the positioning means comprises at least one upwardly projecting protuberance provided on the top surface of the recessed support, at least one hole provided into the container-defining sheet and at least one other hole provided in the container-sealing sheet, said at least one hole and one other hole being sized and positioned to correspond to and be engaged by said protuberance.

2. A kit according to claim 1, wherein the top surface of the container-defining sheet is provided with two of said protuberances, the container-sealing sheet being provided with two of said holes and the container-sealing sheet being provided with two of said other holes, each of said holes and other holes being sized and positioned to correspond to and be engaged by one of said protuberances.

3. A kit according to claim 1, wherein the top surface of the container-sealing sheet comprises information printed on it in such a manner as to be positioned on top of each cover piece and to correspond to what is in the corresponding container.

4. A kit according to claim 2, wherein the recessed support comprises twenty-eight recesses and the container-defining sheet comprises twenty-eight containers, said recesses and containers being evenly positioned so as to define four columns and seven lines.

5. A kit according to claim 2, wherein said kit further comprises a pill-sorting device including a first panel and a second panel stackable onto the top surface of the container-defining sheet after said container-defining sheet is fitted onto the recessed support, said first panel having a top surface comprising a set of half-bottomed recesses which are positioned, sized and shaped exactly like the containers of the container-defining sheet, each of the half-bottomed recesses of said first panel having a bottom wall that extends above one of the containers of the container defining sheet when said first panel is stacked onto the top surface of said container-defining sheet, said bottom wall being provided with a flat surface area and with at least one opening sized to allow at least one pill to fall into the container extending under said bottom wall, said second panel having a top surface comprising a set of hollow bottomed recesses each having a hollow bottom, said hollow bottomed recesses being smaller in size than the half-bottomed recesses of the first panel and being positioned so as to fit into said half-bottomed recesses when the second panel is stacked onto the top surface of the first panel, said hollow bottomed recesses being respectively positioned so as to be slide in unison within the half-bottomed recesses of the first panel between a first position where said hollow bottomed recesses extend over the flat surface areas of the half-bottomed recesses, and a second position where said hollow bottomed recesses extend over the openings made in the half-bottomed recesses, whereby, in use, one may place pills into the half-bottomed recesses of the second panel while said second panel is in the first position, and then slide said first panel so as to cause said pills to fall down into the containers extending under the half-bottomed panels without seeing other pills that may already have been placed into said containers.

6. A kit according to claim 5, wherein the openings in the bottom wall of the half-bottomed recesses of the first panel occupy half of the surface area of said bottom wall and are located on one side of the corresponding half-bottomed recesses.

7. A kit according to claim 5, wherein the second panel is provided with a longitudinal slot and said first and second panels are secured together with at least one rivet passing trough said longitudinal slot and allowing said second panel to horizontally slide with respect to the first panel from the first position to the second position.

8. A kit according to claim 5, wherein the first panel is provided with two further holes, each of these further holes being sized and positioned to correspond to and be engaged by one of the protuberances.

9. A kit according to claim 2, wherein said kit further comprises a device for use to open with a knife the set of individual pill containers after it has been manufactured, said device comprising a flat base member and a "U"-shaped flange which projects downwardly from said flat base member, said "U"-shaped flange member comprising a bottom flange portion and two lateral opposite flanges portions having a given length, said base member and flange portions together defining a cavity sized to fit onto the set of individual pill containers when said set is in an upside down position, each of said two lateral opposite flange portions being provided with a continuous horizontal slot which extends over its length at a short distance from the flat base member so that, when the set of individual pill containers is inserted upside down in the cavity, the slots extends slightly under the bottom of the containers, whereby one can cut the bottoms of the containers of the set of individual pill containers by inserting a knife trough the slots of the two lateral flange and moving said knife from a first position which is distant from the base member to a second position which is close to the base member.

10. A method for the manufacture of a set of individual pill containers, using a kit comprising:

a container-defining sheet made of a plastic material, said container-defining sheet having a top surface comprising a given number of evenly spaced apart cavities embossed therein, each of said cavities being upwardly opened and thus defining a container, each of said containers being surrounded by a flange of a given width provided with a central dotted line punched therein, said dotted line provided in all of said flanges making it possible to detach each of the containers from the container-defining sheet and from the adjacent containers;

a recessed support having a top surface provided with a number of recesses at least equal to the number of cavities embossed in the container-defining sheet, said recessed support being positioned, shaped and sized to receive the containers defined by said cavities embossed in the container-defining sheet;

a container-sealing sheet shaped and sized to cover at least all the containers and surrounding flanges of the container-defining sheet, said container-sealing sheet being provided with tearing lines making it possible to tear said container-sealing sheet into a number of cover pieces corresponding to the number of said containers; and positioning means provided onto at least the top surface of the container-defining sheet and on the container-sealing sheet to ensure that, in use, after the container-defining sheet is fitted onto the recessed support, the paper covering is peeled off from the bands of the container-sealing sheet and said container-sealing sheet is positioned on top of the top surface of the container-defining sheet, the bands covered with a self-adhesive material and their tearing lines being in exact superposition on top of the flanges and the dotted lines of the container-defining sheet;

wherein the recesses of the recessed supports and the cavities of the container-defining sheet are positioned to form regularly spaced apart rows and columns; and wherein the positioning means comprises at least one upwardly projecting protuberance provided on the top surface of the recessed support, at least one hole provided into the container-defining sheet and at least one other hole provided in the container-sealing sheet, said at least one hole and one other hole being sized and positioned to correspond to and be engaged by said protuberance;

said method comprising the steps of:

engaging the cavities of the container-defining sheet into the recesses of the recessed support;

filling each cavity with a given number of pill(s);

engaging the positioning means provided on the top of the container-defining sheet together with the one provided on the container sealing sheet; and pressing and fixing the container-sealing sheet to the top surface of the container-defining sheet, whereby the tearing lines of the container-sealing sheet are in exact superposition on top of the flanges and the dotted lines of the container-defining sheet and become glued to said flanges.

11. A method according to claim 10, further comprising, before the engaging step, the step of printing information on the bottom surface of the sealing sheet using a computerized software in such a manner as to position on top of each cover piece information corresponding to what is in the corresponding container.

12. A method according to claim 10, comprising the additional step, prior to the filling step, of providing a pill-sorting device, said pill-sorting device comprising a first panel and a second panel stackable onto the top surface of the container-defining sheet after said container-defining sheet is fitted onto the recessed support, said first panel having a top surface comprising a set of half-bottomed recesses which are positioned, sized and shaped exactly like the containers of the container-defining sheet, each of the half-bottomed recesses of said first panel having a bottom wall that extends above one of the containers of the container defining sheet when said first panel is stacked onto the top surface of said container-defining sheet, said bottom wall being provided with a flat surface area and with at least one opening sized to allow at least one pill to fall into the container extending under said bottom wall, said second panel having a top surface comprising a set of hollow bottomed recesses each having a hollow bottom, said hollow bottomed recesses being smaller in size than the half-bottomed recesses of the first panel and being positioned so as to fit into said half-bottomed recesses when the second panel is stacked onto the top surface of the first panel, said hollow bottomed recesses being respectively positioned so as to be slidable in unison within the half-bottomed recesses of the first panel between a first position where said hollow bottomed recesses extend over the flat surface areas of the half-bottomed recesses, and a second position where said hollow bottomed recesses extend over the openings made in the half-bottomed recesses, and wherein the filling step comprises the steps of:

placing at least one pill into at least one half-bottomed recess of the second panel while said second panel is in the first position; and then sliding said first panel so as to cause said pill to fall down into the container extending under the half-bottomed panel.

13. A method according to claim 12, wherein the steps of placing and sliding are successively and independently performed for each of the prescribed kinds of pills.

* * * * *